US005588875A

United States Patent [19]

Sawada

[11] Patent Number: 5,588,875

[45] Date of Patent: Dec. 31, 1996

[54] CONNECTOR

[75] Inventor: Yoshitsugu Sawada, Shizuoka-ken, Japan

[73] Assignee: Yazaki Corporation, Tokyo, Japan

[21] Appl. No.: 358,515

[22] Filed: Dec. 19, 1994

[30] Foreign Application Priority Data

Dec. 20, 1993 [JP] Japan ..... 5-320345

[51] Int. Cl.[6] ..... H01R 13/40

[52] U.S. Cl. ..... 439/595; 439/352

[58] Field of Search ..... 439/433–434, 439/352, 595, 598, 677, 680, 733, 752

[56] References Cited

U.S. PATENT DOCUMENTS

| | | | |
|---|---|---|---|
| 4,832,614 | 5/1989 | Jenkins | 439/595 |
| 4,944,688 | 7/1990 | Lundergan | 439/595 |
| 5,071,373 | 12/1991 | Nagasaka et al. | 439/595 |
| 5,122,080 | 6/1992 | Hatagishi et al. | 439/595 |
| 5,145,356 | 9/1992 | Minnis | 439/352 |
| 5,219,300 | 6/1993 | Yagi et al. | 439/352 |
| 5,378,170 | 1/1995 | Abe et al. | 439/595 |
| 5,393,248 | 2/1995 | Yagi et al. | 439/595 |
| 5,458,511 | 10/1995 | Sasai et al. | 439/595 |

FOREIGN PATENT DOCUMENTS

| | | | |
|---|---|---|---|
| 53-137685 | 10/1978 | Japan . | |
| 3-4669 | 1/1991 | Japan . | |
| 4-22079 | 1/1992 | Japan . | |
| 2237458 | 1/1991 | United Kingdom | 439/352 |

*Primary Examiner*—P. Austin Bradley
*Assistant Examiner*—Jill Demello
*Attorney, Agent, or Firm*—Wigman, Cohen, Leitner & Myers, P.C.

[57] ABSTRACT

A connector comprises a connector housing (20) formed with a terminal accommodating chamber (21) and a lance (24); and a terminal (30, 40, 50) inserted into the terminal accommodating chamber of the connector housing and engaged with the lance for prevention of removal of the terminal from the connector housing. In particular, knurled portions (26, 37, 47, 55) are formed both in the lance and the terminal, respectively to prevent the terminal inserted into the terminal accommodating chamber from being moved within the connector housing. When the terminal is inserted into the connector housing, as far as the terminal is not e gaged with the lance, the terminal can be moved within the connector housing for positional adjustment between the two. However, after the terminal has been engaged with the lance, the terminal can be fixed to the connector housing firmly by the presence of the knurled portions. Therefore, the terminal can be fixed to the connector housing firmly, without sacrificing the positional adjustment movement of the terminal within the connector housing, thus preventing contact corrosion due to sliding movement between two mated terminals.

15 Claims, 6 Drawing Sheets

CONNECTOR

BACKGROUND OF THE INVENTION

1. Technical Field

The present invention relates to a connector such that a terminal can be fixed to a connector housing with a predetermined degree of movement freedom.

2. Description of the Related Art

An example of the prior art connectors of this type is shown in FIGS. 1A and 1B, which is disclosed in Japanese Published Unexamined Utility Model Application No. 4-22079. In this connector, a connector housing 1 is formed with a plurality of internal terminal accommodating chambers 2 and a plurality of mated terminal insertion holes 3 each communicating with each terminal chamber 2. When the terminals 4 are assembled with the connector housing 1, the terminals 4 are inserted into the terminal accommodating chambers 2 from below, and further a holder 7 formed with a plurality of lances 6 for preventing the inserted terminals 4 from being removed from the connector housing 1 is inserted into the connector housing 1 through a side hole 5 formed in the connector housing 1. Under these conditions, since the terminals 4 can be prevented from being removed from connector housing 1 by the holder 7, a connector can be assembled. In this connector 4, circular terminals (pin socket type terminals) are used. In the case of the circular terminals 4, since the terminals can be rotated to some extent within the terminal accommodating chambers 2 respectively; that is, the terminals 4 can be inserted into the connector housing 1 irrespective of the direction of the wire clamping portion of the terminal, there exists such an advantage that the assembly work of the connectors can be automatized.

Further, there exists another connector such that a play (the degree of freedom) is provided in a predetermined direction to permit an angular positional adjustment between the terminal and the housing to some extent, which is one of the methods of facilitating the automatization of the connector assembly.

In the above-mentioned connector provided with a degree of movement freedom with respect to the terminal position within the connector housing, on the other hand, there exists such a problem in that the terminal tends to be rotated or slid within the connector housing even after having been engaged with the lance of the connector housing, with the result that the contact portion of the terminal is not stable and thereby there exists a possibility of occurrence of corrosion due to minute sliding motion of the terminal at the contact portion.

SUMMARY OF THE INVENTION

With these problems in mind, therefore, it is the object of the present invention to provide a connector which can fix the terminal to the connector housing securely after having been engaged with the connector housing lance, without reducing the degree of movement freedom of the angular positional adjustment between the terminal and the connector housing, so that the corrosion due to minute sliding motion can be prevented at the contact portion between two mated terminals.

To achieve the above-mentioned solution, the present invention provides a connector having: a connector housing (20) formed with a terminal accommodating chamber (21) and a lance (24); and a terminal (30, 40, 50) inserted into the terminal accommodating chamber of the connector housing and engaged with the lance for prevention of removal of the terminal from the connector housing; and wherein at least one of the lance and the terminal is provided with terminal movement preventing means (26, 37, 47, 55) for preventing the terminal inserted into the terminal accommodating chamber of the connector housing from being moved within the connector housing.

In the connector, the terminal is a circular terminal (30, 40) rotatable within the terminal accommodating chamber of the connector housing, and the terminal movement preventing means is a lance side knurled portion (26) formed in the lance (24) along a direction perpendicular to a terminal insertion direction and a terminal side knurled portion (37, 47) formed on an outer circumferential of the terminal so as to be engaged with the lance side knurled portion (26).

Further, the circular terminal (30) is composed of a cylindrical body (33) and a terminal body (32) inserted into the cylindrical body, and the terminal side knurled portion (37) is formed on an outer circumference of a flange portion (36) of the terminal body (32). Or else, the circular terminal (40) is composed of a cylindrical body (43) and a terminal body (42) inserted into the cylindrical body, and the terminal side knurled portion (47) is formed on an outer circumference of the cylindrical body (43).

Further, the terminal is a square terminal (50) movable in a direction perpendicular to a terminal insertion direction, and the terminal movement preventing means is a lance side knurled portion (26) formed in the lance (24) along a direction perpendicular to a terminal insertion direction and a terminal side knurled portion (55) formed on a bottom plate surface (53) of the square terminal.

In the connector according to the present invention, before the terminal is fixed by the lance of the connector housing, the terminal can be moved freely within the connector housing for positional adjustment in an automatic assembly line. However, after the terminal has been engaged with the lance of the connector housing, the terminal can be fixed to the connector housing by the movement preventing means at an adjusted engagement position.

DETAILED DESCRIPTION OF THE EMBODIMENTS

Embodiments of the connector according to the present invention will be described hereinbelow with reference to the attached drawings.

Figure 1A:
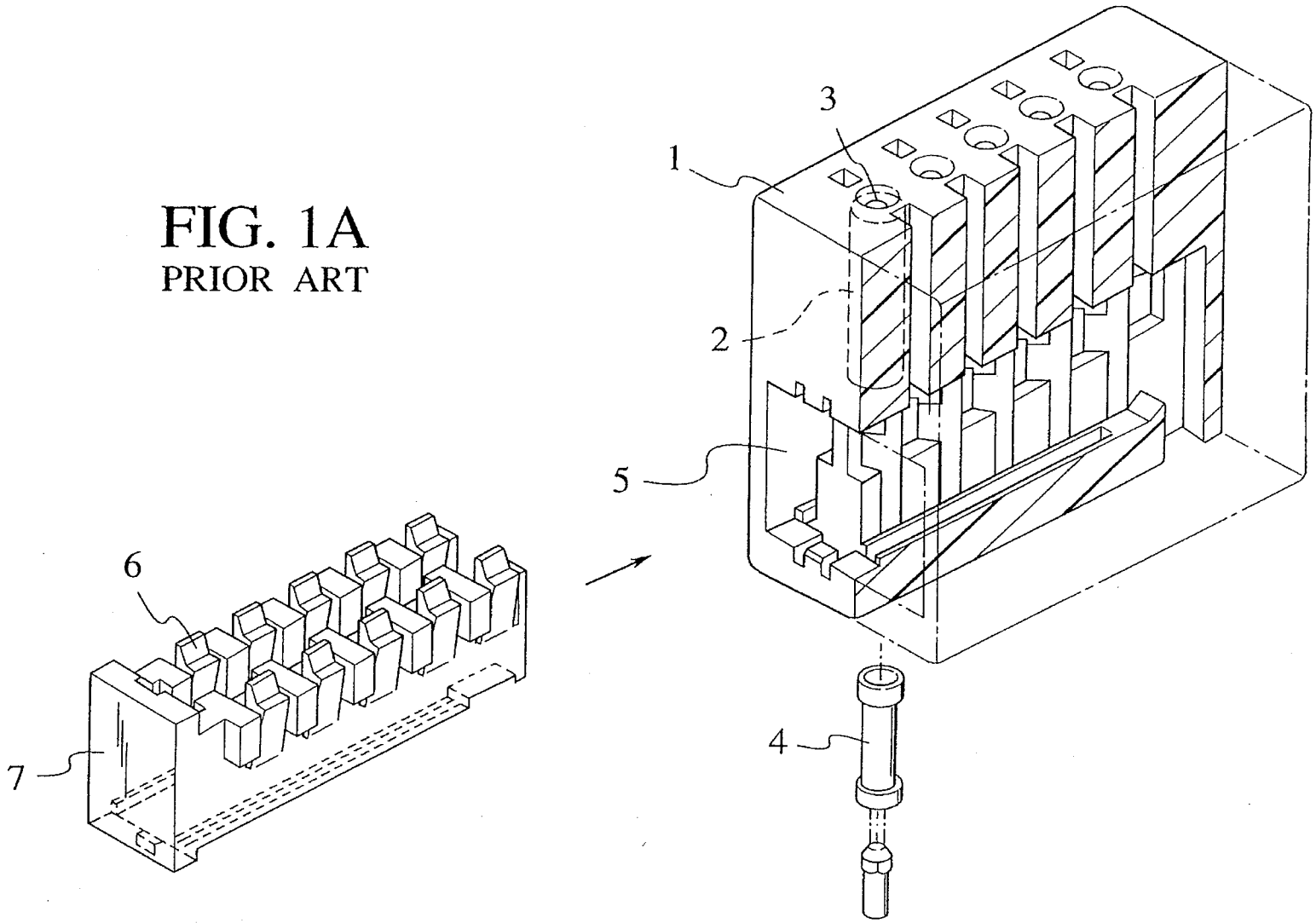
FIG. 1A PRIOR ART
FIG. 1A is an exploded perspective view showing an example of prior art connector having a plurality of circular female terminals.
Figure 1B:
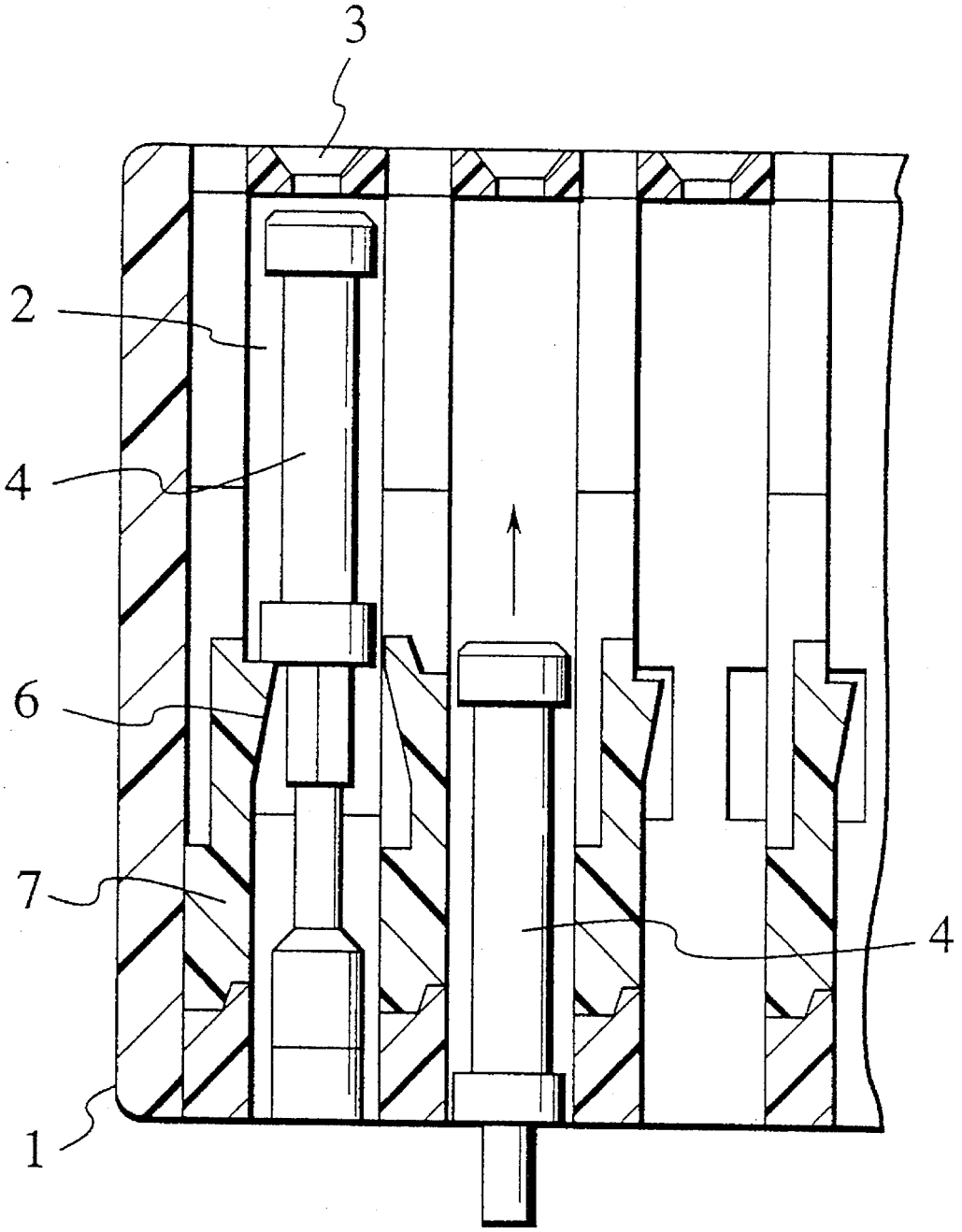
FIG. 1B PRIOR ART
FIG. 1B is a cross-sectional view showing the connector having the circular female terminals shown in FIG. 1A.
Figure 2:
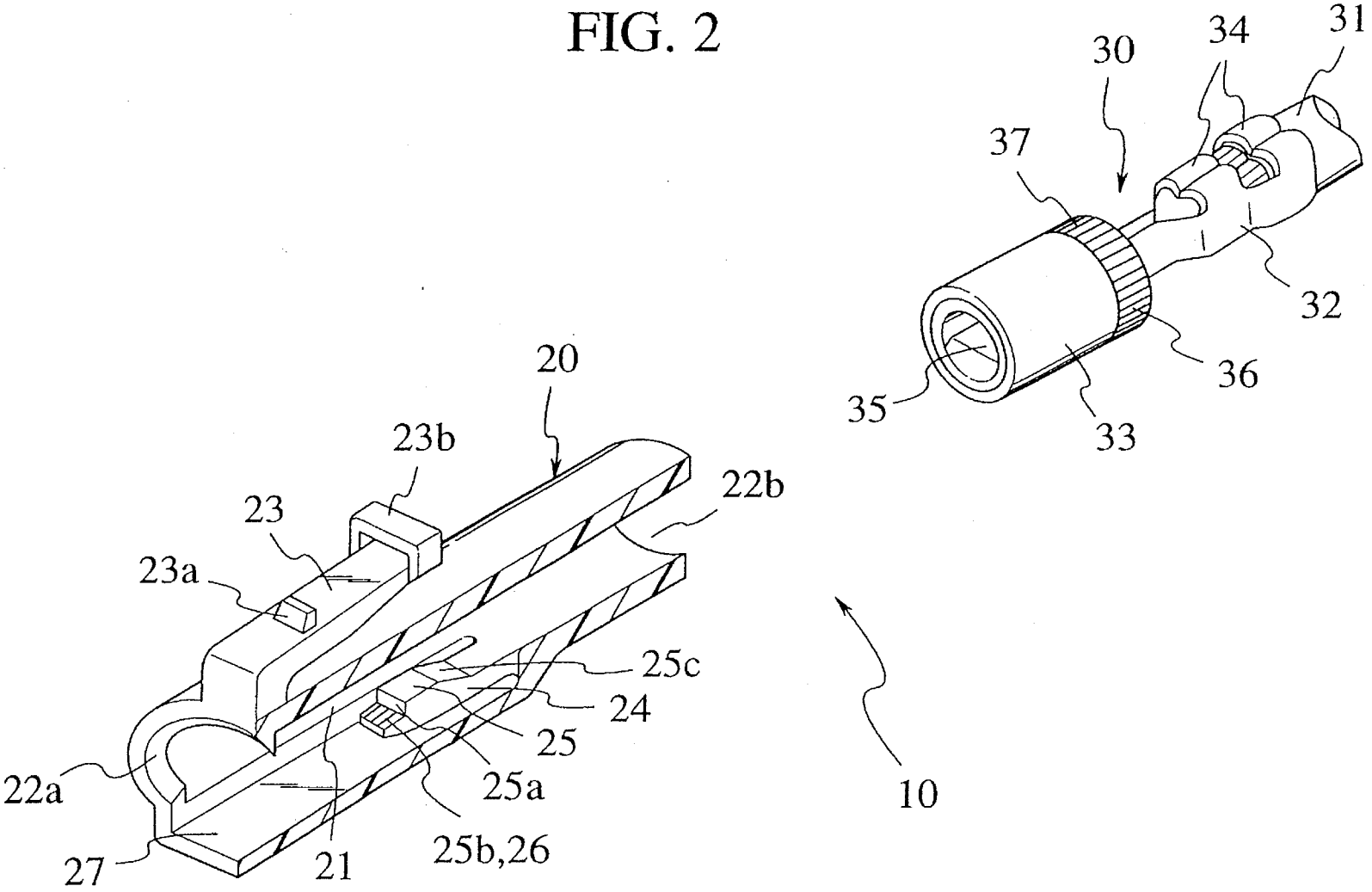
FIG. 2 is an exploded perspective, partially cross-section view showing a first embodiment of the connector according to the present invention.

FIG. 2 shows a first embodiment of the connector according to the present invention. In FIG. 2, a connector 10 is composed of a resin connector housing 20 and a circular terminal 30 inserted into the connector housing 20. In the following description, the left downward direction is referred to as the front side; the right upward direction is referred to as the rear side; the left upward direction is referred to as the left side; and the right downward direction is referred to as the right side, respectively, in FIG. 2.

Figure 3:
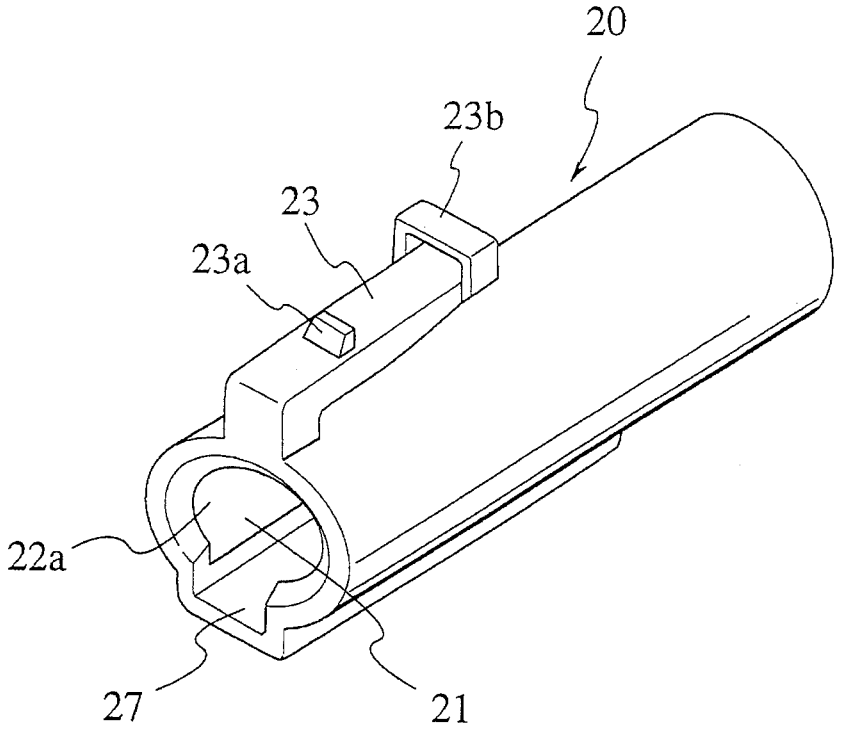
FIG. 3 is a perspective view showing a connector housing of the first embodiment of the connector according to the present invention.

As shown in FIG. 3, the connector housing 20 is formed into a cylindrical shape and with a circular terminal accommodating chamber 21. The terminal accommodating chamber 21 is formed with a mated terminal insertion opening 22*a* at the front end thereof and a terminal insertion opening 22*b* at the rear end thereof. The circular terminal 30 is inserted along the axial direction of the connector housing 20 (referred to as a terminal insertion direction, hereinafter). The connector housing 20 is formed with a lock arm 23 for locking a mated male connector (not shown) at an outer surface thereof. The lock arm 23 is formed with a lock projection 23*a* engaged with an engage hole (not shown) of the mated male connector and a lock release portion 23*b* for releasing the engagement between the mated male connector (not shown) and the female connector 10.

The connector housing 20 is formed with a lance 24 (which serves as elastic engaging means) in the lower wall surface of the internal terminal accommodating chamber 21. The lance 24 is formed integral with the housing 20 in such a way as to extend from the inner rear end circumferential wall of the connector housing 20. The lance 24 is of cantilever type and formed with an inner projection portion 25 projecting inward in the terminal accommodating chamber 21 at the middle portion thereof.

This projection portion 25 is formed with a first engage wall 25*a* facing frontward and a second engage wall 25*b* facing upward in the terminal accommodating chamber 21 and extending parallel to the terminal insertion direction. The surface of the second engage wall 25*b* is formed with a lance side knurled portion 26 for prevention of the rotational movement of the terminal 30 inserted into the connector housing 20. The knurled portion 26 is provided with a plurality of projections arranged in the direction perpendicular to the terminal insertion direction. Further, the projection portion 25 is formed with a guide slope surface 25*c* for guiding the insertion of the terminal 20 into the connector housing 20 at the rear end surface thereof. The lance 24 is formed in a recessed portion 27 formed in the bottom surface of the connector housing 20.

Figure 4:
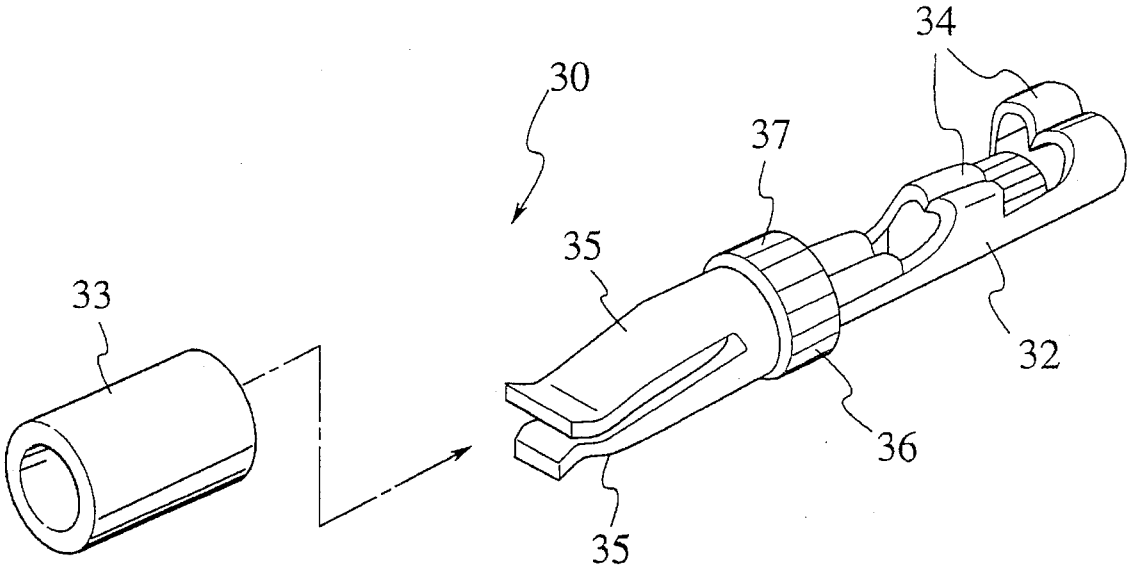
FIG. 4 is a perspective view showing a circular female terminal of the first embodiment of the connector according to the present invention.

On the other hand, the circular terminal 30 is composed of a terminal body 32 connected to a wire 31 and a cylindrical body 33 fixedly fitted to the front portion of the terminal body 32. As shown in FIG. 4, the terminal body 32 is formed with two wire clamping portions 34 at the rear end thereof, a pair of pinching pieces 35 for pinching a mated male terminal inserted from the front end thereof, and a flange portion 36 at the middle portion thereof so as to be brought into contact with the rear end surface of the cylindrical body 33. The outer circumferential surface of this flange portion 36 is formed with a terminal side knurled portion 37 provided with a plurality of projections arranged in the circumferential direction of the flange portion 36. The terminal side knurled portion 37 can be engaged with the lance side knurled portion 26 formed in the lance 24 of the connector housing 20.

The terminal body 32 and the cylindrical body 33 are assembled to each other as the circular terminal 30 as shown in FIG. 2. The assembled circular terminal 30 is inserted into the terminal accommodating chamber 21 of the connector housing 20. Under the conditions that the circular terminal 30 is inserted into the connector housing 20, the circular terminal 30 can be pivoted or rotated therewithin.

The function of the connector according to the present invention will be described hereinbelow.

When the circular terminal 30 is assembled with the connector housing 20, the terminal body 32 and the cylindrical body 33 are previously assembled with each other. The assembled circular terminal 30 is inserted into the connector housing 20 through the terminal insertion opening 22*b*. Then, since the front end of the circular terminal 30 is brought into contact with the guide slope surface 25*c* of tile lance 24, the lance 24 is deformed elastically outward. At this time point, the circular terminal 30 can be pivoted freely, so that it is possible to adjust the mutual angular position between the connector housing 20 and the circular terminal 30. This adjustment is necessary when the assembly work of the circular terminal 30 with the connector housing 20 is automatized.

When the circular terminal 30 is further inserted into the connector housing 20, since the flange portion 36 of the circular terminal 30 is inserted passing over the projection portion 25 of the lance 24, the projection portion 25 of the lance 24 is elastically returned at the rear side of the flange portion 36 of the terminal body 32, so that the first en age wall 25*a* of the front end of the projection portion 25 is engaged with the rear end surface of the flange portion 36. As a result, it is possible to prevent the circular terminal 30 from being removed from the connector housing 20.

At the same time, since the second engage wall 25*b* of the projection portion 25 is brought into contact with the outer circumference of the flange portion 36, the lance-side knurled portion 26 formed on the surface of the second engage wall 25*b* is engaged with the terminal side knurled portion 37 formed one the outer circumference of the flange portion 36 of the terminal body 32 of the circular terminal 30, so that it is possible to fix the circular terminal 30 to the connector housing 20 for prevention of rotation of the circular terminal 30 within the connector housing 20. That is, the circular terminal 30 can be fixed to the connector terminal 20 firmly, thus it being possible to prevent corrosion due to minute sliding motion at the contact portion between the two mated terminals.

Figure 5:
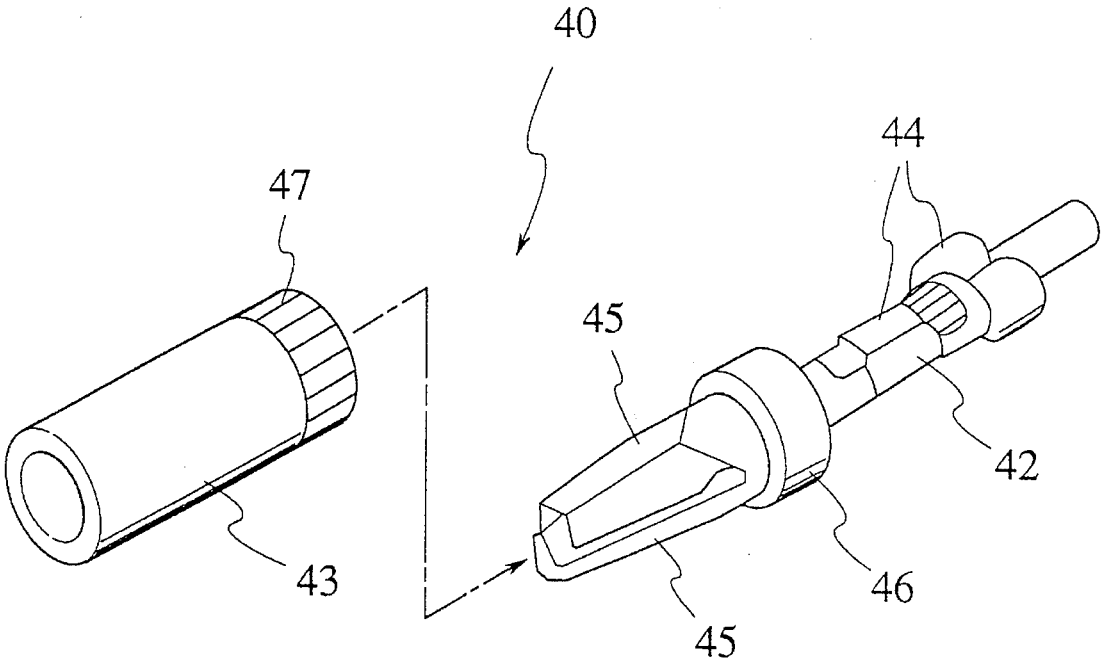
FIG. 5 is a perspective view showing a circular female terminal of a modification of the first embodiment of the connector according to the present invention.

Further, in the above-mentioned first embodiment, although the terminal side knurled portion 37 is formed at the flange portion 36 of the terminal body 32 of the circular terminal 30, it is also possible to provide the terminal side knurled portion on the cylindrical body (33) side, as shown in FIG. 5. In this modification, the circular terminal 40 is composed of the terminal body 42 and the cylindrical body 43. The terminal body 42 of the circular terminal 40 is formed with the two wire clamping portions 44 at the rear end! thereof, the elastic pinching pieces 45 at the front end thereof, and the flange portion 46 at the middle portion thereof. The terminal side knurled portion 47 is formed on the rear side outer circumference of the cylindrical body 43.

Figure 6A:
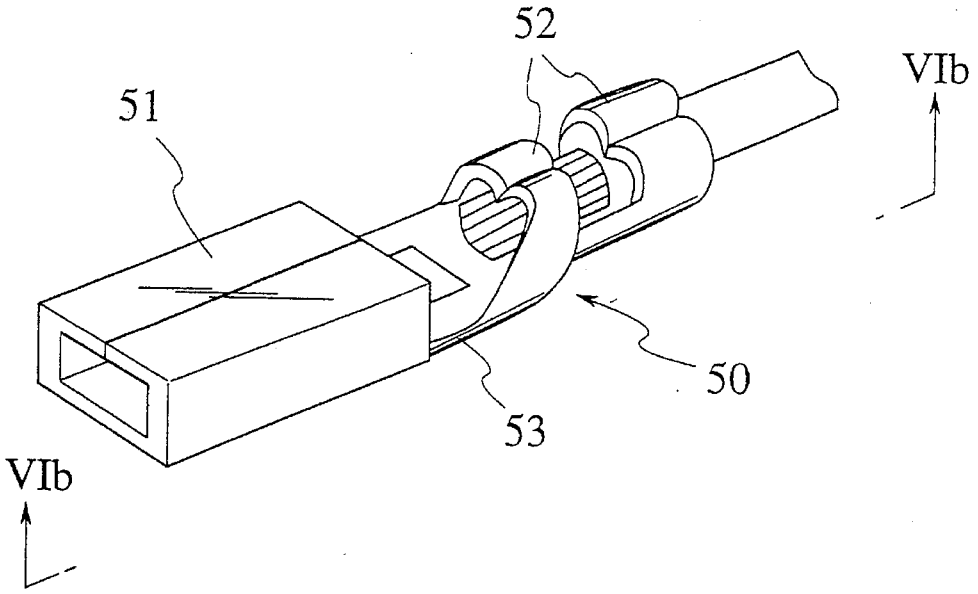
FIG. 6A is a perspective view showing a square female terminal of a second embodiment of the connector according to the present invention.

In the first embodiment as described above, although the circular terminals 30 and 40 are shown. It is also possible to use a square terminal as shown in Figs. 6(A) and (B). In this case, a slight degree of freedom can be given to the direction perpendicular to the terminal insertion direction.

Figure 6B:
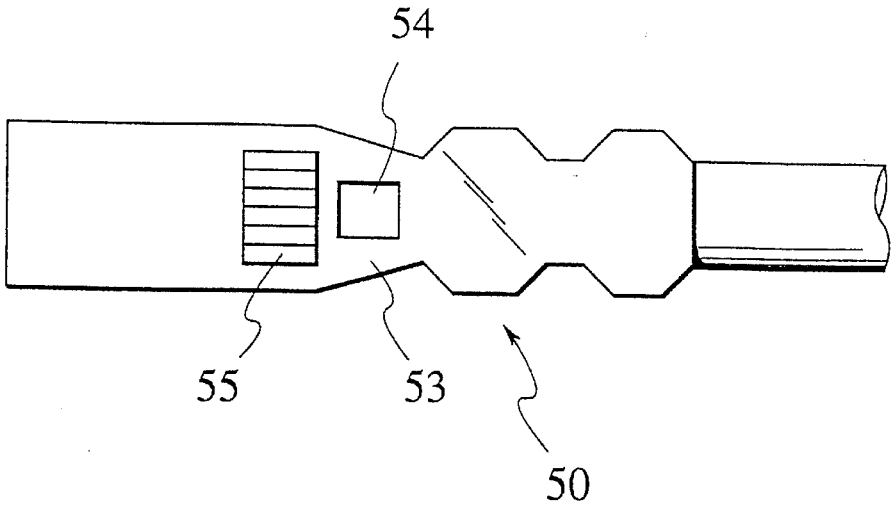
FIG. 6B is a bottom view showing the square female terminal shown in FIG. 5(*a*).

In more detail, a second embodiment of the connector according to tile present invention is provided with a square terminal 50 as shown in FIGS. 6A and 6B. The square terminal 50 is formed with a square female cylindrical portion 51 mated with a mated male terminal (not shown) at the front end thereof, two wire clamping portions 52 at the rear end thereof, and a bottom plate 53 for connecting both portions 51 and 52. Further, at the middle portion of the bottom plate 53, an engage hole 54 is formed with which the projection portion 25 of the lance 24 of the connector housing 20 is engaged. In this engage hole 54, a dimension in the right and left direction (in the vertical direction in FIG. 6B) is set slightly larger than that of the projection portion 25 of the lance 24. Further, the terminal side knurled portion 55 is formed in the lower surface of the bottom plate 53 in front of the engage hole 54 in such way as to be engaged with the lance side knurled portion 26.

In this second embodiment, when the square terminal 50 is inserted into the connector housing 20, before the square terminal 50 is fixed by the lance 24, the square terminal 50 can be moved in the right and left direction (perpendicular to the terminal insertion direction ) to some extent for providing the positional adjustment of the square terminal 50 within the connector housing 20. Further, after the lance 24 has been perfectly engaged with the engage hole 54 of the square terminal 50, since the terminal side knurled portion 55 is engaged with the lance side knurled portion 26, the square terminal 50 can be fixed to the connector housing 20 without being moved in the right and left direction, so that it is possible to prevent corrosion due to minute sliding motion at the contact portion between the two mated terminals.

Further, in the second embodiment, it is preferable to use a square connector housing (not shown) in correspondence to the square terminal 50.

In the above-mentioned embodiments, since the elastic deformable lance 24 is formed with the lance side knurled portion 26 (as the terminal movement preventing means), where the knurled portions are each formed into a triangular shape in cross section, as far as the terminal is rotated by a force exceeding a predetermined value, it is possible to disengage the terminal side knurled portion 37, 47 and 55 from the lance side knurled portion 26, so that the terminal can be rotated to some extent by a strong force. However, under the normal conditions, since the terminal is engaged with the lance via the knurled portions under an elastic force of the lance, the terminal can be securely fixed to the connector housing.

Further, in the above-mentioned embodiments, although the gist of the present invention has been explained by taking the case of the female connector by way of example, it is of course possible to apply the present invention to the male connector.

As described above, in the present invention, it is possible to securely fix the terminal to the connector housing after the terminal has been engaged with lance of the connector housing, without sacrificing the feature that the terminal engage position can be adjusted within the connector housing. Therefore, the assembly work of the connector according to the present invention can be automatized while reducing the corrosion due to minute sliding motion at the connector contact portions.

What is claimed is:

1. A connector having:

a connector housing formed with a terminal accommodating chamber and a lance;

a terminal rotatable within and inserted into the terminal accommodating chamber of the connector housing and engaged with the lance for prevention of removal of the terminal from the connector housing; and terminal rotation preventing means provided on at least one of the lance or the terminal for preventing the terminal inserted into the terminal accommodating chamber of the connector housing from being rotated within the connector housing.

2. The connector of claim 1, wherein said terminal has a circular cross-section.

3. The connector of claim 1, wherein said terminal rotation preventing means comprises knurled portions on said lance and said terminal.

4. The connector of claim 3, wherein said knurled portions are formed into a triangular shape in transverse cross-section.

5. The connector of claim 3, wherein said terminal comprises a terminal body and a cylindrical body affixed to said terminal body.

6. The connector of claim 5, wherein said knurled portions are on said cylindrical body.

7. The connector of claim 5, wherein said knurled portions are on said terminal body.

8. A connector having:

a connector housing formed with a terminal accommodating chamber and a lance;

a terminal rotatable within and inserted into the terminal accommodating chamber of the connector housing and engaged with the lance for prevention of removal of the terminal from the connector housing; and terminal movement preventing means for preventing the terminal inserted into the terminal accommodating chamber of the connector housing from being moved within the connector housing, said terminal movement preventing means comprising a lance side knurled portion formed in the lance along a direction perpendicular to a terminal insertion direction and a terminal side knurled portion formed on an outer:circumferential portion of the terminal so as to be engaged with the lance side knurled portion.

9. The connector of claim 8, wherein the circular terminal has a cylindrical body and a terminal body inserted into the cylindrical body, and the terminal side knurled portion is formed on an outer circumference of a flange portion of the terminal body.

10. The connector of claim 8, wherein the circular terminal has a cylindrical body and a terminal body inserted into the cylindrical body, and the terminal side knurled portion is formed on an outer circumference of the cylindrical body.

11. The connector of claim 8, wherein said terminal has a circular cross-section.

12. A connector having:

a connector housing formed with a terminal accommodating chamber and a lance;

a terminal inserted into the terminal accommodating chamber of the connector housing and movable in a direction perpendicular to a terminal insertion direction, said terminal being engaged with the lance for prevention of removal of the terminal from the connector housing; and terminal movement preventing means for preventing the terminal inserted into the terminal accommodating chamber of the connector housing from being moved within the connector housing, said terminal movement preventing means comprising a lance side knurled portion formed in the lance along a direction perpendicular to the terminal insertion direction and a terminal side knurled portion formed on a bottom plate surface of the terminal so as to be engaged with the lance side knurled portion.

13. The connector of claim 12, wherein said terminal has a rectangular cross-section.

14. A connector comprising;

a connector housing formed with a terminal accommodating chamber and a lance;

a terminal inserted into the terminal accommodating chamber of the connector housing in a first direction and engaged with the lance for prevention of removal of the terminal from the connector housing; and terminal movement preventing means provided on the lance and the terminal for preventing the terminal inserted into the terminal accommodating chamber of the connector housing from being moved within the connector housing in a direction transverse to the first direction;

wherein said terminal movement preventing means comprises knurled portions on said lance and said terminal.

15. A connector comprises;

a connector housing formed with a terminal accommodating chamber and a lance;

a terminal inserted into the terminal accommodating chamber of the connector housing in a first direction and engaged with the lance for prevention of removal of the terminal from the connector housing; and terminal movement preventing means provided on the lance and the terminal for preventing the terminal inserted into the terminal accommodating chamber of the connector housing from being moved within the connector housing in a direction transverse to the first direction;

wherein said knurled portions are formed into a triangular shape in transverse cross-section.

* * * * *